US007714690B2

(12) United States Patent
Shoji et al.

(10) Patent No.: US 7,714,690 B2
(45) Date of Patent: May 11, 2010

(54) COIL COMPONENT

(75) Inventors: Atsushi Shoji, Tokyo (JP); Masatoshi Shindoh, Tokyo (JP); Yoshiaki Kitajima, Tokyo (JP)

(73) Assignee: TDK Corporation, Tokyo (JP)

( * ) Notice: Subject to any disclaimer, the term of this patent is extended or adjusted under 35 U.S.C. 154(b) by 201 days.

(21) Appl. No.: 12/010,165

(22) Filed: Jan. 22, 2008

(65) Prior Publication Data

US 2008/0179445 A1 Jul. 31, 2008

(30) Foreign Application Priority Data

Jan. 30, 2007 (JP) ..... 2007-019903

(51) Int. Cl.
*H01F 27/24* (2006.01)
*H01F 17/04* (2006.01)
*H01F 27/28* (2006.01)

(52) U.S. Cl. ..... 336/212; 336/198; 336/221

(58) Field of Classification Search ..... 336/212, 336/208, 198, 220, 221
See application file for complete search history.

(56) References Cited

U.S. PATENT DOCUMENTS 6,965,289 B2 * 11/2005 Toi et al. ..... 336/83
7,522,028 B2 * 4/2009 Sano ..... 336/212
2006/0268457 A1 11/2006 Sano

FOREIGN PATENT DOCUMENTS

| | | |
|---|---|---|
| JP | U-1-71410 | 5/1989 |
| JP | A-4-364706 | 12/1992 |
| JP | A-10-270256 | 10/1998 |
| JP | A-2003-151832 | 5/2003 |
| JP | A-2005-135948 | 5/2005 |
| JP | A-2006-332263 | 12/2006 |

* cited by examiner

*Primary Examiner*—Anh T Mai
(74) *Attorney, Agent, or Firm*—Oliff & Berridge, PLC

(57) ABSTRACT

A coil component has a first coil part and a second coil part, a middle member, and a shield member. Each of the first and second coil parts includes a drum core and a winding. The middle member is located between the first and second coil parts arranged in a state in which axes of winding drums in the respective first and second coil parts are parallel to each other. The shield member is formed at least in part of an outside surface of the winding in each of the first and second coil parts and is a resin containing a magnetic material powder. The magnetic permeability of the middle member is lower than that of the core and the shield member.

6 Claims, 9 Drawing Sheets

COIL COMPONENT

BACKGROUND OF THE INVENTION

1. Field of the Invention

The present invention relates to a coil component in which first and second coil parts are coupled together.

2. Related Background Art

Japanese Patent Application Laid-open No. 2006-332263 describes a coil component comprised of two coil parts and a middle core. Each of the two coil parts has a drum core with a winding wound thereon. The middle core couples the two coil parts to each other to form closed magnetic paths with their drum cores.

SUMMARY OF THE INVENTION

In the coil component described in the foregoing Application Laid-open No. 2006-332263, the middle core functions as a common magnetic path to the two coil parts. In this case, a problem of occurrence of crosstalk arises when a signal is allowed to flow simultaneously through the two coil parts.

The present invention has been accomplished in order to solve the above problem and an object of the invention is to provide a coil component with a first coil part and a second coil part being coupled together, which is capable of achieving reduction in crosstalk between the first and second coil parts.

A coil component of the present invention comprises: a first coil part and a second coil part each of which includes a core having a winding drum and a flange located at least at one end of the winding drum, and a winding arranged in the winding drum; a middle member located between the first coil part and the second coil part arranged in a state in which axes of the winding drums in the respective first and second coil parts are parallel to each other; and a resinous shield member formed at least in part of peripheral surfaces of the respective first and second coil parts and containing a magnetic material powder; wherein a magnetic permeability of the middle member is lower than that of the core and the shield member.

In the coil component of the present invention, the middle member with the magnetic permeability lower than that of the core and the shield member is located between the first coil part and the second coil part. This configuration reduces the crosstalk between the first coil part and the second coil part. Since the shield member is formed at least in part of the peripheral surfaces of the respective first and second coil parts, mutually different magnetic paths are formed for the first and second coil parts. Consequently, this configuration enhances the shield effect and improves the inductance characteristics. Since the shield member is resinous, it can be readily formed at any position on the first and second coil parts even in the coil component of a compact size.

Preferably, the middle member is bonded to the flange with an adhesive. When the coil component is constructed in this configuration, the middle member can define a distance between the first coil part and the second coil part in a production process. This can reduce variation in the distance between the first and second coil parts. Therefore, a minimum distance can be defined taking the crosstalk between the first and second coil parts into account whereby the coil component can be constructed in a more compact size.

Preferably, the middle member is a resinous member and is in close contact with the first and second coil parts. In this case, the middle member is filled and hardened between the first and second coil parts and in gaps to enhance the strength of the component.

Preferably, the magnetic permeability of the shield member is lower than that of the core. This allows the shield member to exercise a function equivalent to a gap, in a magnetic path composed of the core and the shield member. Therefore, it becomes feasible to achieve excellent DC bias characteristic.

The present invention reduces the crosstalk between the first and second coil parts in the coil component in which the first coil part and the second coil part are coupled together.

DESCRIPTION OF THE PREFERRED EMBODIMENTS

The preferred embodiments of the present invention will be described below in detail with reference to the accompanying drawings. The same elements or elements with the same functionality will be denoted by the same reference symbols throughout the description, without redundant description.

First Embodiment

Figure 1:
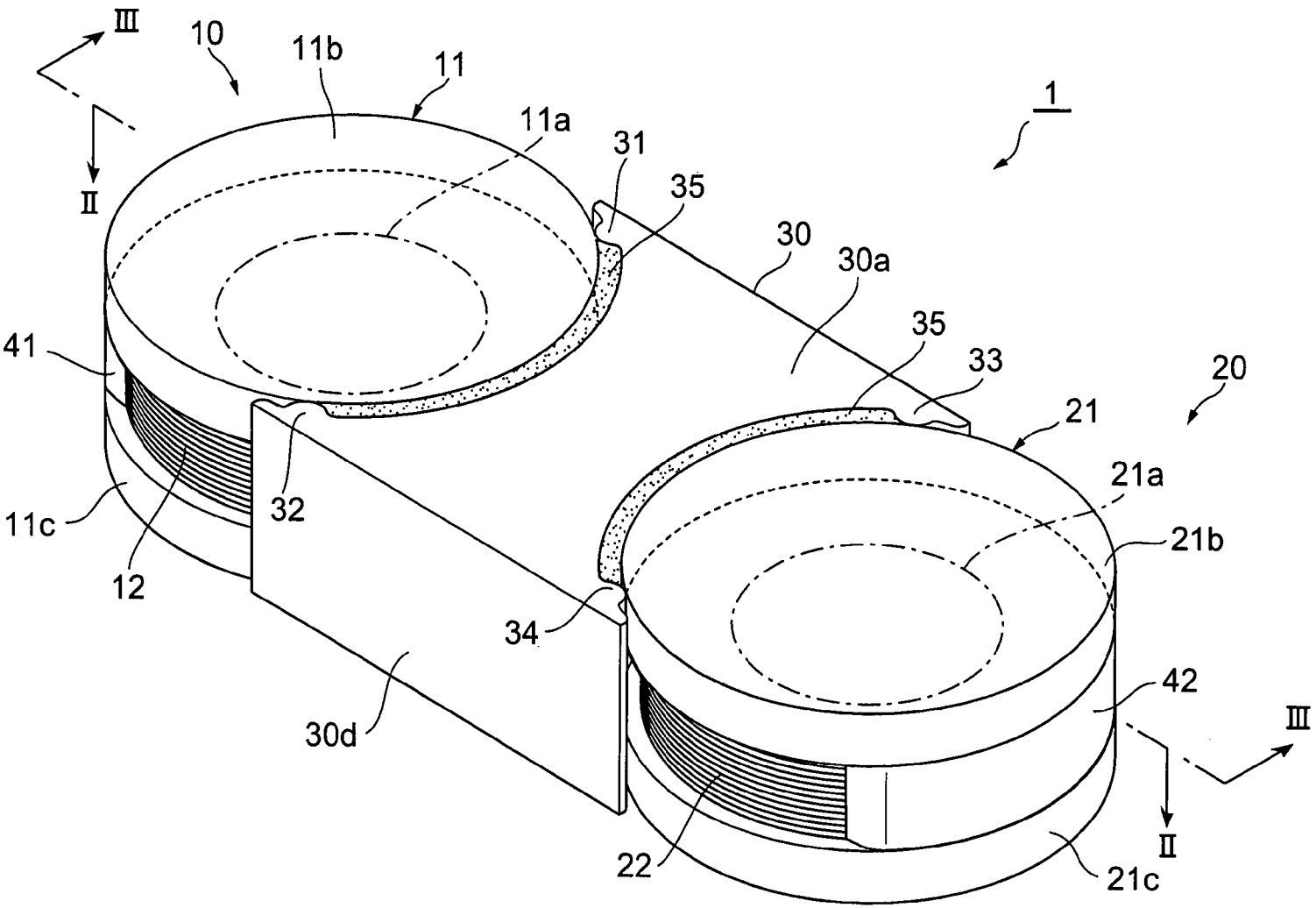
FIG. 1 is a perspective view of a coil component according to the first embodiment.
Figure 2:
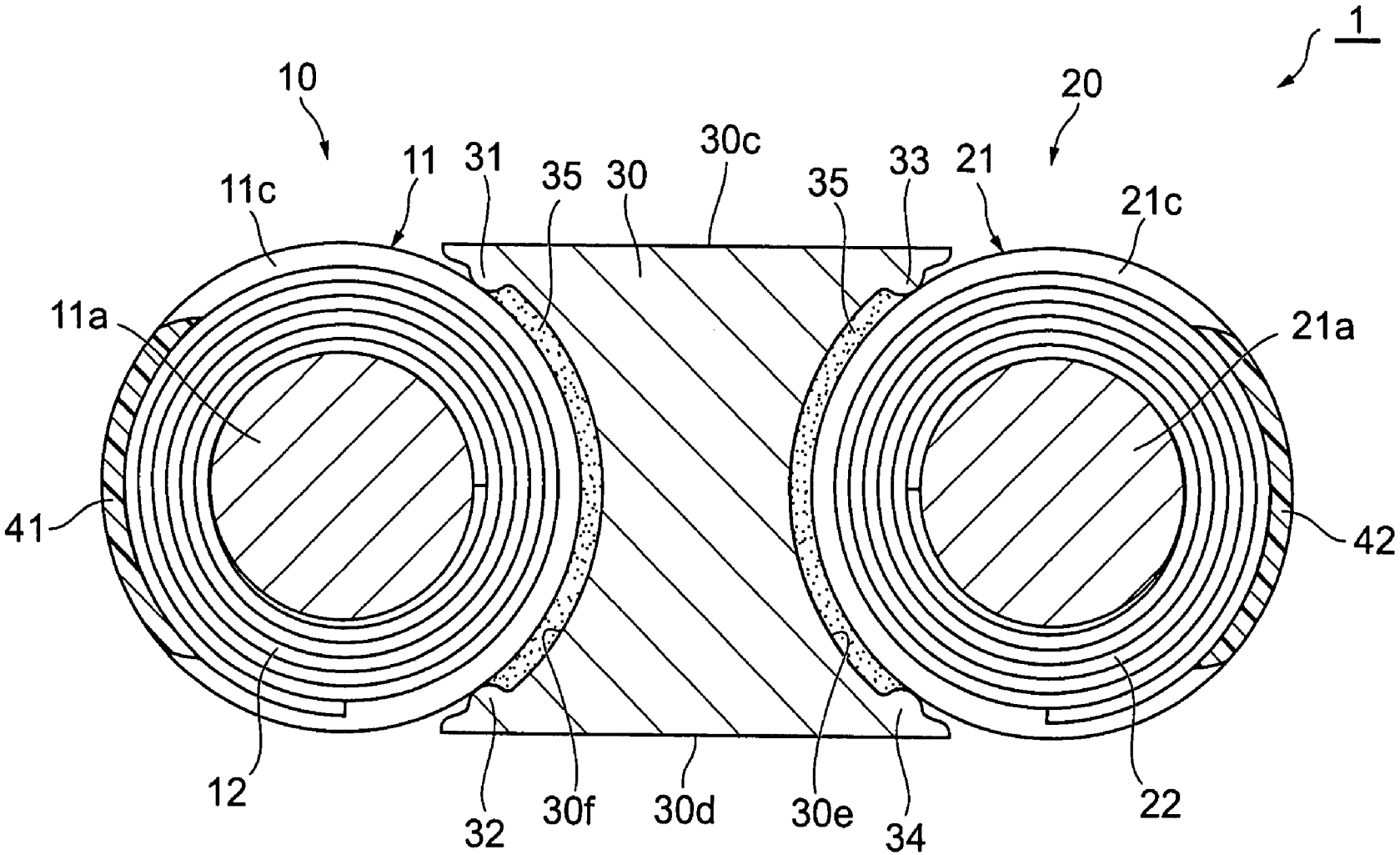
FIG. 2 is a schematic view showing a II-II cross section of the coil component shown in FIG. 1.
Figure 3:
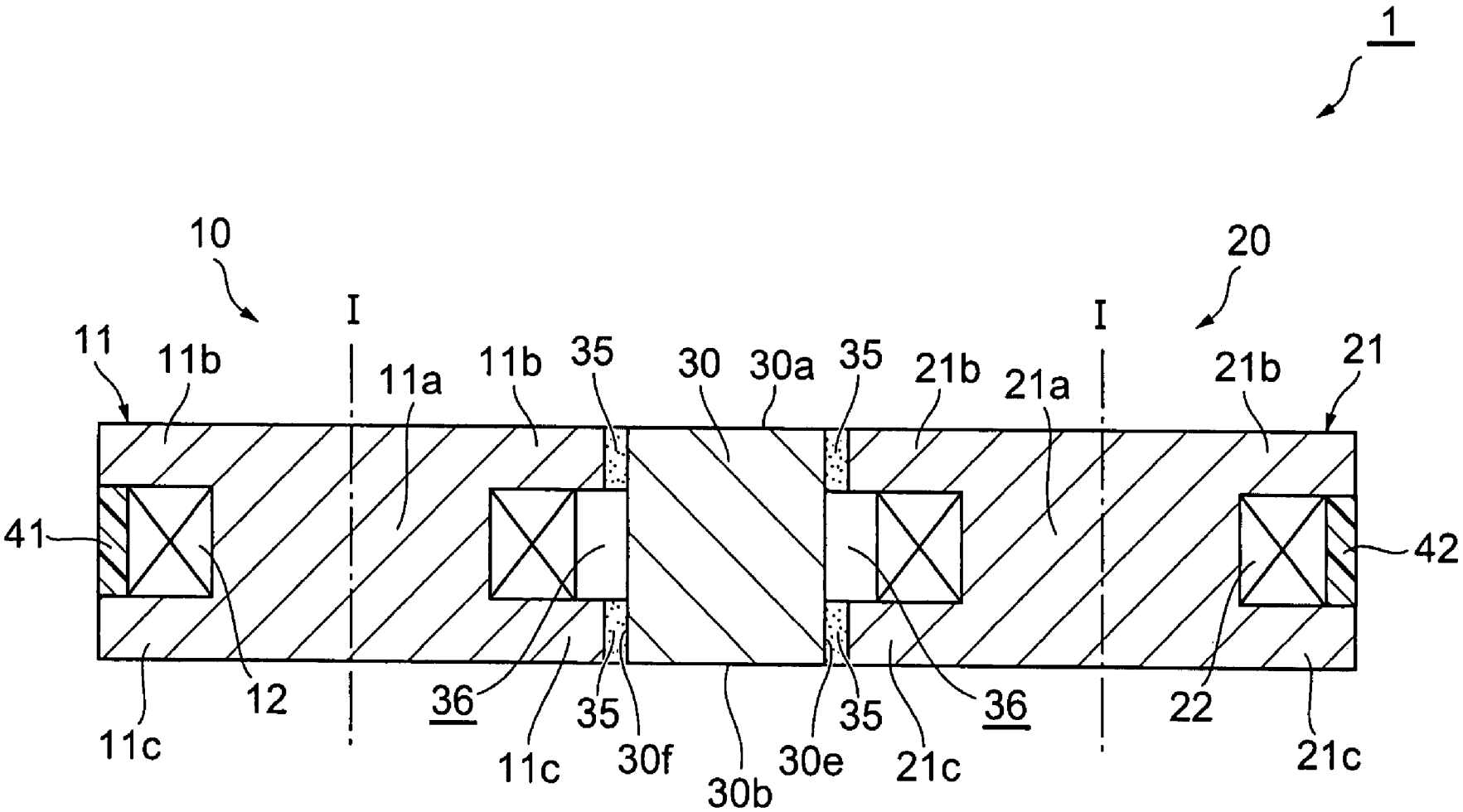
FIG. 3 is a schematic view showing a III-III cross section of the coil component shown in FIG. 1.
Figure 4:
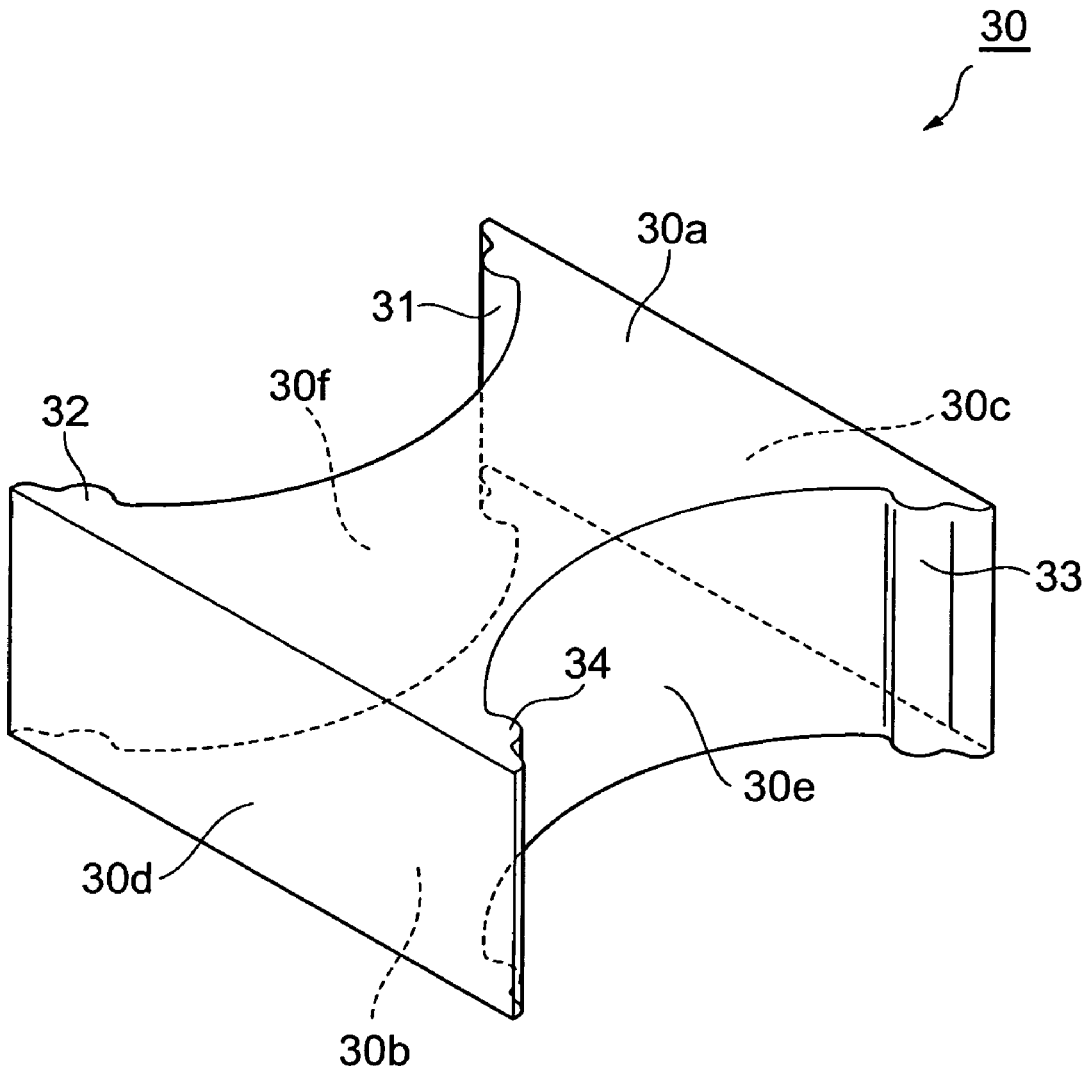
FIG. 4 is a perspective view of a middle member in the coil component shown in FIG. 1.

A configuration of a coil component 1 according to the first embodiment will be described with reference to FIGS. 1 to 4. FIG. 1 is a perspective view of the coil component according to the first embodiment. FIG. 2 is a schematic view showing a II-II cross section of the coil component shown in FIG. 1. FIG. 3 is a schematic view showing a III-III cross section of the coil component shown in FIG. 1. FIG. 4 is a perspective view of a middle member in the coil component shown in FIG. 1.

The coil component 1 of the present embodiment is composed of a first coil part 10 and a second coil part 20, a middle member 30, and shield members 41, 42. The middle member 30 is located between the first coil part 10 and the second coil part 20. The shield members 41, 42 are formed in the first and second coil parts 10, 20, respectively.

The first coil part 10 is composed of a core 11 and a winding 12. The core 11 is a drum core and has a winding drum 11*a* of a circular cylinder shape, and flanges 11*b*, 11*c* provided at the two ends of the winding drum 11*a*. Each of the flanges 11*b*, 11*c* radially spreads in directions normal to the axis I, from the axis I of the winding drum 11*a* and the periphery thereof is formed in a circular shape. Any cross section including the axis I of the winding drum 11*a* in the core 11 is an H-shape and is symmetrical with respect to the axis I. The core 11 is made of a magnetic material such as ferrite. The relative magnetic permeability μ of the core 11 is approximately 300. The winding 12 is a conducting wire coated with an insulating material. The winding 12 is wound around the winding drum 11*a* of the core 11. FIG. 2 shows the cross section II-II perpendicular to the axis I through the winding 12.

The second coil part 20 is composed of a core 21 and a winding 22 similar to those of the first coil part 10, and thus has the shape and configuration similar to the first coil part 10. The core 21 includes a winding drum 21*a*, and flanges 21*b*, 21*c* provided at the two ends of the winding drum 21*a*. The first coil part 10 and the second coil part 20 are arranged so that the axes I of the respective winding drums 11*a*, 21*a* are parallel to each other. FIG. 3 shows the cross section III-III in a plane including the axis I of the winding drum 11*a* and the axis I of the winding drum 21*a*.

The middle member 30, as shown in FIG. 4, includes a plane 30*a* and a plane 30*b* opposed in parallel to each other, a plane 30*c* and a plane 30*d* perpendicular to the planes 30*a*, 30*b* and opposed in parallel to each other, and a curved surface 30*e* and a curved surface 30*f* opposed to each other.

The planes 30*a* and 30*b* are planes perpendicular to the direction of the axes I of the winding drums 11*a*, 21*a*. The plane 30*a* is flush with the outside surface normal to the axis I in the flange 11*b*. The plane 30*b* is flush with the outside surface normal to the axis I in the flange 11*c*. Namely, the size in the direction of the axes I in the middle member 30 is approximately equal to the size in the direction of the axes I of the first and second coil parts 10, 20.

The planes 30*c* and 30*d* are planes parallel to the direction of the axes I and the row direction of the first and second coil parts 10, 20. The distance between the plane 30*c* and the plane 30*d* is approximately equal to the diameter of the peripheral circles in the flanges 11*b*, 11*c*, 21*b*, 21*c*. The plane 30*c* and the plane 30*d* are flush with two respective tangent planes to the peripheral circles of the flanges 11*b*, 11*c*, 21*b*, 21*c*, which are opposed to each other.

The curved surface 30*f* is located on the first coil part 10 side. The curved surface 30*f* is depressed on the curved surface 30*e* side so as to extend along the flanges 11*b*, 11*c* and a cross section thereof normal to the axis I is a nearly half circle having the curvature approximately equal to that of the flanges 11*b*, 11*c*. The curved surface 30*e* is located on the second coil part 20 side. The curved surface 30*e* is depressed on the curved surface 30*f* side so as to extend along the flanges 21*b*, 21*c* and a cross section thereof normal to the axis I is a nearly half circle having the curvature approximately equal to that of the flanges 21*b*, 21*c*.

The middle member 30 has a bulge 31 continuously extending from the plane 30*a* to the plane 30*b* on the plane 30*c* side of the curved surface 30*f*. The middle member 30 has a bulge 32 continuously extending from the plane 30*a* to the plane 30*b* on the plane 30*d* side of the curved surface 30*f*. The middle member 30 has a bulge 33 continuously extending from the plane 30*a* to the plane 30*b* on the plane 30*c* side of the curved surface 30*e*. The middle member 30 has a bulge 34 continuously extending from the plane 30*a* to the plane 30*b* on the plane 30*d* side of the curved surface 30*e*. The bulges 31-34 are semicircular in a cross section normal to the axes I.

The bulges 31 and 32 are in contact with the peripheral surfaces of the flanges 11*b*, 11*c* of the first coil part 10 near their top. A space surrounded by the curved surface 30*f*, the bulge 31, the bulge 32, and the peripheral surface of the flange 11*b* of the first coil part 10 is filled with an adhesive 35, and the adhesive 35 bonds between the first coil part 10 and the middle member 30. A space surrounded by the curved surface 30*f*, the bulge 31, the bulge 32, and the peripheral surface of the flange 11*c* of the first coil part 10 is filled with the adhesive 35 and the adhesive 35 bonds between the first coil part 10 and the middle member 30. A gap 36 is present between the curved surface 30*f* and the winding 12 of the first coil part 10. This gap 36 may also be filled with the adhesive.

The bulges 33 and 34 are in contact with the peripheral surfaces of the flanges 21*b*, 21*c* of the second coil part 20 near their top. A space surrounded by the curved surface 30*e*, the bulge 33, the bulge 34, and the peripheral surface of the flange 21*b* of the second coil part 20 is filled with the adhesive 35 and the adhesive 35 bonds between the second coil part 20 and the middle member 30. A space surrounded by the curved surface 30*e*, the bulge 33, the bulge 34, and the peripheral surface of the flange 21*c* of the second coil part 20 is filled with the adhesive 35 and the adhesive 35 bonds between the second coil part 20 and the middle member 30. A gap 36 is present between the curved surface 30*e* and the winding 22 of the second coil part 20. This gap 36 may also be filled with the adhesive.

As described above, the bulges 31-34 form the spaces filled with the adhesive. While the bulges 31-34 are in contact with the first and second coil parts 10, 20, they exercise a function to determine the relative positions of the first and second coil parts 10, 20. The middle member 30 is made of a material with the magnetic permeability lower than that of the core 11. The middle member 30 is made of alumina ($Al_2O_3$) or sintered ferrite and the relative magnetic permeability μ thereof is approximately 1.

The shield member 41 is formed on the outside surface of the winding 12 in the first coil part 10. The shield member 41 is formed between the flange 11*b* and the flange 11*c* on the outside surface of the winding 12 in a wound state. This shield member 41 is in contact with each of the surfaces on the winding 12 side perpendicular to the axis I in the flange 11*b* and the flange 11*c*. The shield member 41 is formed on the side opposite to the middle member 30. The shield member 42 is formed on the outside surface of the winding 22 in the second coil part 20. The shield member 42 is formed between the flange 21*b* and the flange 21*c* on the outside surface of the winding 22 in a wound state. The shield member 42 is in contact with each of the surfaces on the winding 22 side perpendicular to the axis I in the flange 21*b* and the flange 21*c*. The shield member 42 is formed on the side opposite to the middle member 30.

The shield members 41, 42 are made of a resin containing a magnetic material powder. The magnetic permeability of the shield members 41, 42 is lower than that of the cores 11, 21 but higher than that of the middle member 30. The relative magnetic permeability μ of the shield members 41, 42 is approximately 5.

A closed magnetic path is made by the winding drum 11*a*, the part of the flange 11*b* opposite to the middle member 30, the shield member 41, and the part of the flange 11*c* opposite to the middle member 30. A closed magnetic path is also made by the winding drum 21*a*, the part of the flange 21*b* opposite to the middle member 30, the shield member 42, and the part of the flange 21*c* opposite to the middle member 30. Namely, the shield members 41, 42 form their respective different closed magnetic paths for the first coil part 10 and for the second coil part 20.

The size of the shield members 41, 42 in a direction perpendicular to the direction of the axes I and the row direction of the first and second coil parts 10, 20 is preferably as large as over the diameter of the winding drums 11*a*, 21*a*. This allows the coil component to establish the closed magnetic paths more efficient in terms of the magnetic flux density.

The coil component 1 is constructed in symmetry with respect to a plane including the axis I of the winding drum 11*a* and the axis I of the winding drum 21*a*. When the direction of the axes I is defined as a vertical direction, the coil component 1 is made in symmetry with respect to a vertical center line and a horizontal center line.

The coil component 1 described above can be produced as described below. First, the windings 12, 22 are wound around the respective winding drums 11*a*, 21*a* of the drum cores 11, 21 to form the first coil part 10 and the second coil part 20. Then the middle member 30 is molded. Next, the flanges 11*b*, 11*c* of the first coil part 10 are placed in contact with the bulges 31, 32 of the middle member 30 and the flanges 21*b*, 21*c* of the second coil part 20 are placed in contact with the bulges 33, 34 of the middle member 30.

Subsequently, the spaces surrounded by the curved surface 30*f*, the bulge 31, the bulge 32, and the peripheral surfaces of the flanges 11*b*, 11*c* are filled with the adhesive 35 to bond the first coil part 10 to the middle member 30. The spaces surrounded by the curved surface 30*e*, the bulge 33, the bulge 34, and the peripheral surfaces of the flanges 21*b*, 21*c* are filled with the adhesive 35 to bond the second coil part 20 to the middle member 30. Thereafter, the resin containing the magnetic material powder is applied to form the shield members 41, 42.

In this manner, the coil component 1 is produced in the size of about 1 mm in the direction of the axes I, in the size of about 6 mm in the row direction of the first and second coil parts 10, 20, and in the size of about 2.5 mm in the direction perpendicular to the direction of the axes I and the row direction. It is also possible to adopt a method of first forming the shield members 41, 42 on the first coil part 10 and on the second coil part 20, respectively, and then bonding the first coil part 10 and the second coil part 20 to the middle member 30 with the adhesive 35.

Since in the coil component 1 of the present embodiment described above, the middle member 30 having the magnetic permeability lower than those of the cores 11, 21 and the shield members 41, 42 is located between the first coil part 10 and the second coil part 20, the crosstalk is reduced between the first coil part 10 and the second coil part 20.

Since in the coil component 1 the shield members 41, 42 are formed on the outside surfaces in the wound state of the windings 12, 22 in the respective first and second coil parts 10, 20, the separate magnetic paths are formed in the first and second coil parts 10, 20, so as to enhance the magnetic flux density. Consequently, this configuration enhances the shield effect and improves the inductance characteristics.

In the coil component 1, the cores 11, 21 have the flanges 11*b*, 11*c*, 21*b*, 21*c* located at the ends of the winding drums 11*a*, 21*a*, and the shield members 41, 42 are formed between the flange 11*b* and the flange 11*c* and between the flange 21*b* and the flange 21*c*, respectively. This permits the closed magnetic path to be made by the winding drum 11*a*, 21*a*, the flanges 11*b*, 11*c*; 21*b*, 21*c*, and the shield member 41, 42 in each of the first and second coil parts 10, 20.

The shield member 41 is located at the position opposite to and apart from the second coil part 20, in the first coil part 10 and the shield member 42 is located at the position opposite to and apart from the first coil part 10, in the second coil part 20; therefore, the crosstalk is further reduced between the first coil part 10 and the second coil part 20.

In the coil component 1, the shield members 41, 42 are resinous, and therefore they can be readily formed at any positions on the first and second coil parts 10, 20 even in the coil component 1 of a compact size.

In the coil component 1 the middle member 30 is bonded to the portions on the middle member 30 side of the flanges 11*b*, 11*c*, 21*b*, 21*c* with the adhesive 35. Furthermore, the first coil part 10 is in contact with the bulges 31, 32 of the middle member 30 and the second coil part 20 in contact with the bulges 33, 34 of the middle member 30. This allows the distance between the first and second coil parts 10, 20 to be defined by the middle member 30 in the production process, which reduces variation in the distance between the first and second coil parts 10, 20. Accordingly, it becomes feasible to define a minimum distance taking the crosstalk between the first and second coil parts 10, 20 into account and to construct the coil component in a more compact size.

In the coil component 1 the magnetic permeability of the shield members 41, 42 is lower than that of the cores 11, 21. This configuration allows the shield members 41, 42 to exercise a function equivalent to a gap in the magnetic paths made by the cores 11, 21 and the shield members 41, 42, so as to enable achievement of excellent DC bias characteristic. Namely, it becomes feasible to achieve the DC bias characteristic as excellent as that of a structure in which the cores 11, 21 are provided with a gap.

The necessary condition for the shield members is that they are formed at least in part of the peripheral surfaces of the respective first and second coil parts 10, 20, and a variety of modifications can be contemplated as to the forming positions of the shield members. The shield members may be located between the flange 11*b* and the flange 11*c* and between the flange 21*b* and the flange 21*c*, and may be formed on the peripheral portions of the flanges 11*b*, 11*c*, 21*b*, 21*c*. Besides them, first and second modification examples will be described below as examples of the first embodiment.

First Modification Example of First Embodiment

Figure 5:
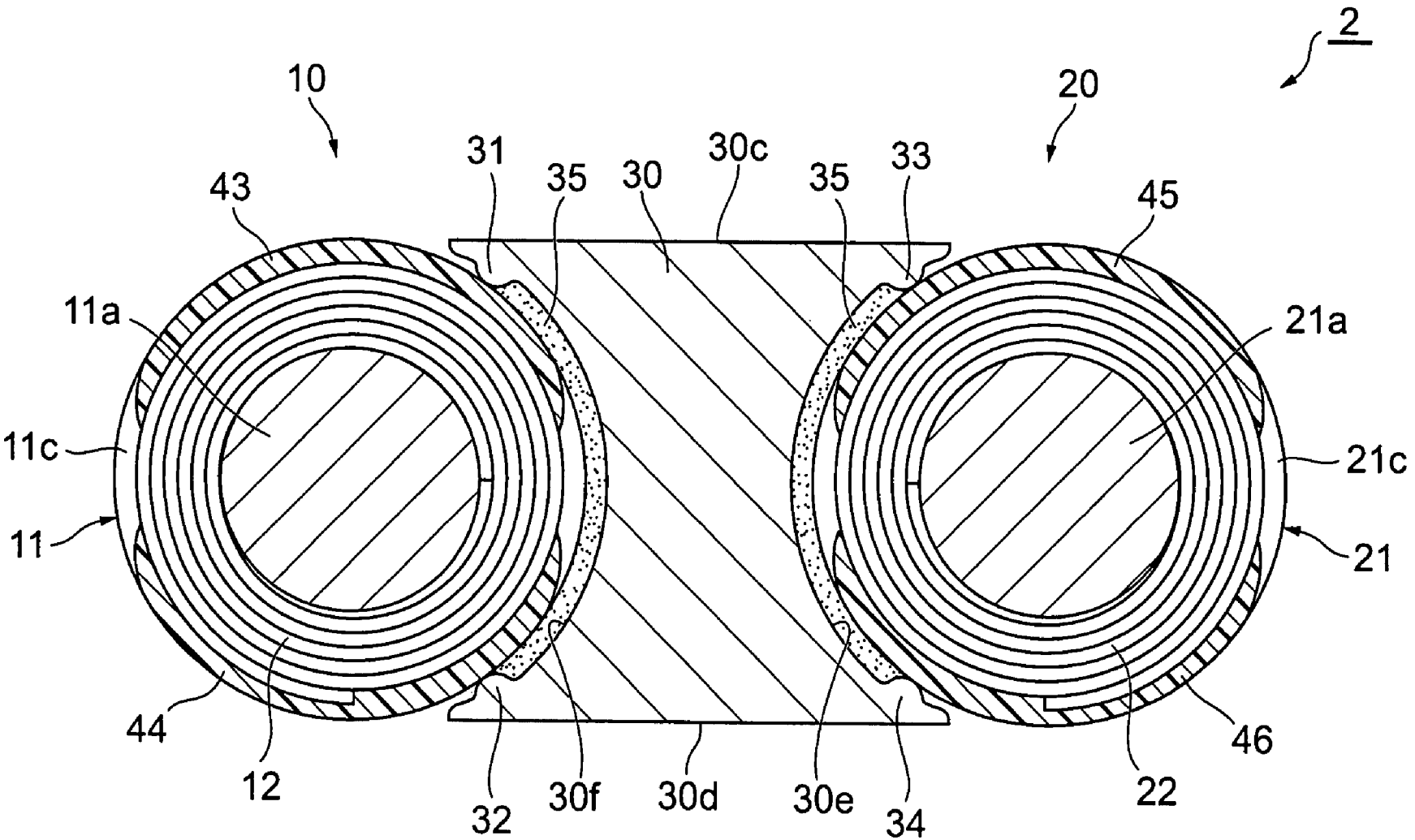
FIG. 5 is a schematic view of a coil component according to a first modification example of the first embodiment.

FIG. 5 is a sectional view of a coil component according to the first modification example of the first embodiment. The coil component 2 according to the first modification example of the first embodiment is composed of a first coil part 10, a second coil part 20, and a middle member 30 similar to those in the aforementioned coil component 1. The middle member 30 is bonded to the first coil part 10 and to the second coil part 20 with the adhesive 35 as in the coil component 1.

The shield members 43-46 in the coil component 2 will be described below. The shield members 43, 44 are formed on the outside surface of the winding 12 in the wound state on the winding drum 11*a* in the first coil part 10. The shield members 43, 44 are filled between the flange 11*b* and the flange 11*c*. The shield members 43, 44 are in contact with the flanges 11*b*, 11*c*. The shield member 43 is located on the plane 30*c* side of the middle member 30 with respect to the winding drum 11*a* and the shield member 44 on the plane 30*d* side of the middle member 30 with respect to the winding drum 11*a*. The shield member 43 and the shield member 44 are not in contact with each other and are separated with a gap in between.

The shield members 45, 46 are formed on the outside surface of the winding 22 in the wound state on the winding drum 21*a* in the second coil part 20. The shield members 45, 46 are filled between the flange 21*b* and the flange 21*c*. The shield members 45, 46 are in contact with the flanges 21*b*, 21*c*. The shield member 45 is located on the plane 30*c* side of the middle member 30 with respect to the winding drum 21*a* and the shield member 46 on the plane 30*d* side of the middle member 30 with respect to the winding drum 21*a*. The shield member 45 and the shield member 46 are not in contact with each other and are separated with a gap in between.

In the coil component 2, a closed magnetic path is made by the winding drum 11*a*, the flange 11*b* on the plane 30*c* side, the shield member 43, and the flange 11*c* on the plane 30*c* side. Another closed magnetic path is made by the winding drum 11*a*, the flange 11*b* on the plane 30*d* side, the shield member 44, and the flange 11*c* on the plane 30*d* side. A closed magnetic path is made by the winding drum 21*a*, the flange 21*b* on the plane 30*c* side, the shield member 45, and the flange 21*c* on the plane 30*c* side. Another closed magnetic path is made by the winding drum 21*a*, the flange 21*b* on the plane 30*d* side, the shield member 46, and the flange 21*c* on the plane 30*d* side.

The shield member 43 and the shield member 44 are made each by pouring a resin of a material from the mutually opposed portions on the plane 30*c* side and on the plane 30*d* side in the winding drum 11*a*, on the outside surface of the winding 12 in the wound state. The shield member 45 and the shield member 46 are made each by pouring the resin of the material from the mutually opposed portions on the plane 30*c* side and on the plane 30*d* side in the winding drum 21*a*, on the outside surface of the winding 22 in the wound state. It should be noted that the shield member 43 and the shield member 44 may be arranged in contact with each other and that the shield member 45 and the shield member 46 may be arranged in contact with each other.

Second Modification Example of Second Embodiment

Figure 6:
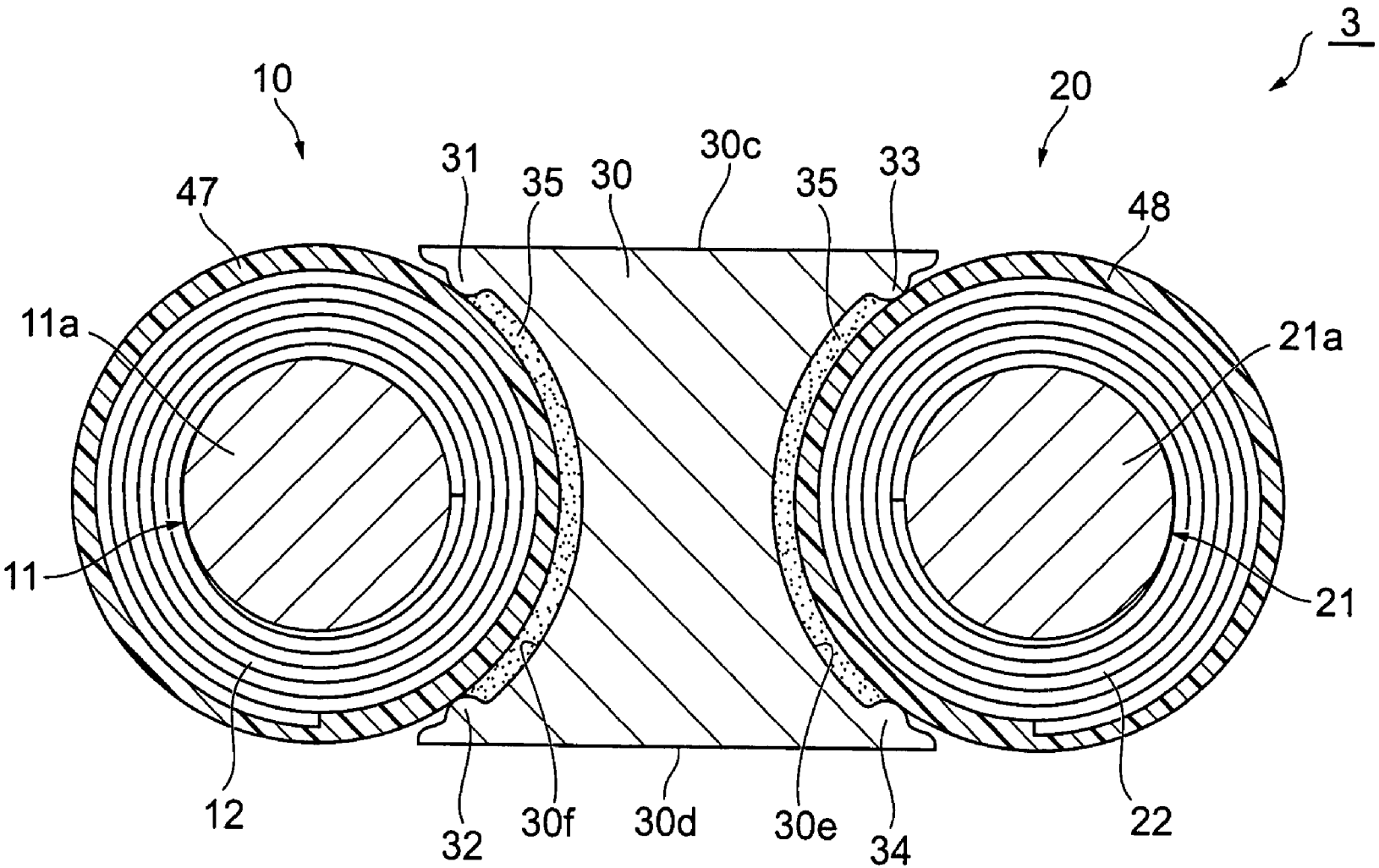
FIG. 6 is a schematic view of a coil component according to a second modification example of the first embodiment.

FIG. 6 is a sectional view of a coil component according to the second modification example of the first embodiment. The coil component 3 according to the second modification example of the first embodiment is composed of a first coil part 10, a second coil part 20, and a middle member 30 similar to those in the aforementioned coil component 1. The middle member 30 is bonded to the first coil part 10 and to the second coil part 20 with the adhesive 35 as in the coil component 1.

The shield members 47, 48 in the coil component will be described below. The shield member 47 is formed on the outside surface of the winding 12 in the wound state on the winding drum 11*a* in the first coil part 10 and is filled between the flange 11*b* and the flange 11*c*. The shield member 47 is formed throughout the entire circumference of the outside surface of the winding 12 in the wound state and is in contact with the flanges 11*b*, 11*c* throughout the entire circumference. The shield member 48 is formed on the outside surface of the winding 22 in the wound state on the winding drum 21*a* in the second coil part 20 and is filled between the flange 21*b* and the flange 21*c*. The shield member 48 is formed throughout the entire circumference of the outside surface of the winding 22 in the wound state and is in contact with the flanges 21*b*, 21*c* throughout the entire circumference.

The shield members 47, 48 cover the entire region of the outside surface of the respective windings 12, 22 in the wound state in the first and second coil parts 10, 20, so as to enhance the inductance characteristics. In addition, the shield effect is improved in each of the first coil part 10 and the second coil part 20, whereby the crosstalk between the first and second coil parts 10, 20 can be reduced more definitely.

Second Embodiment

Figure 7:
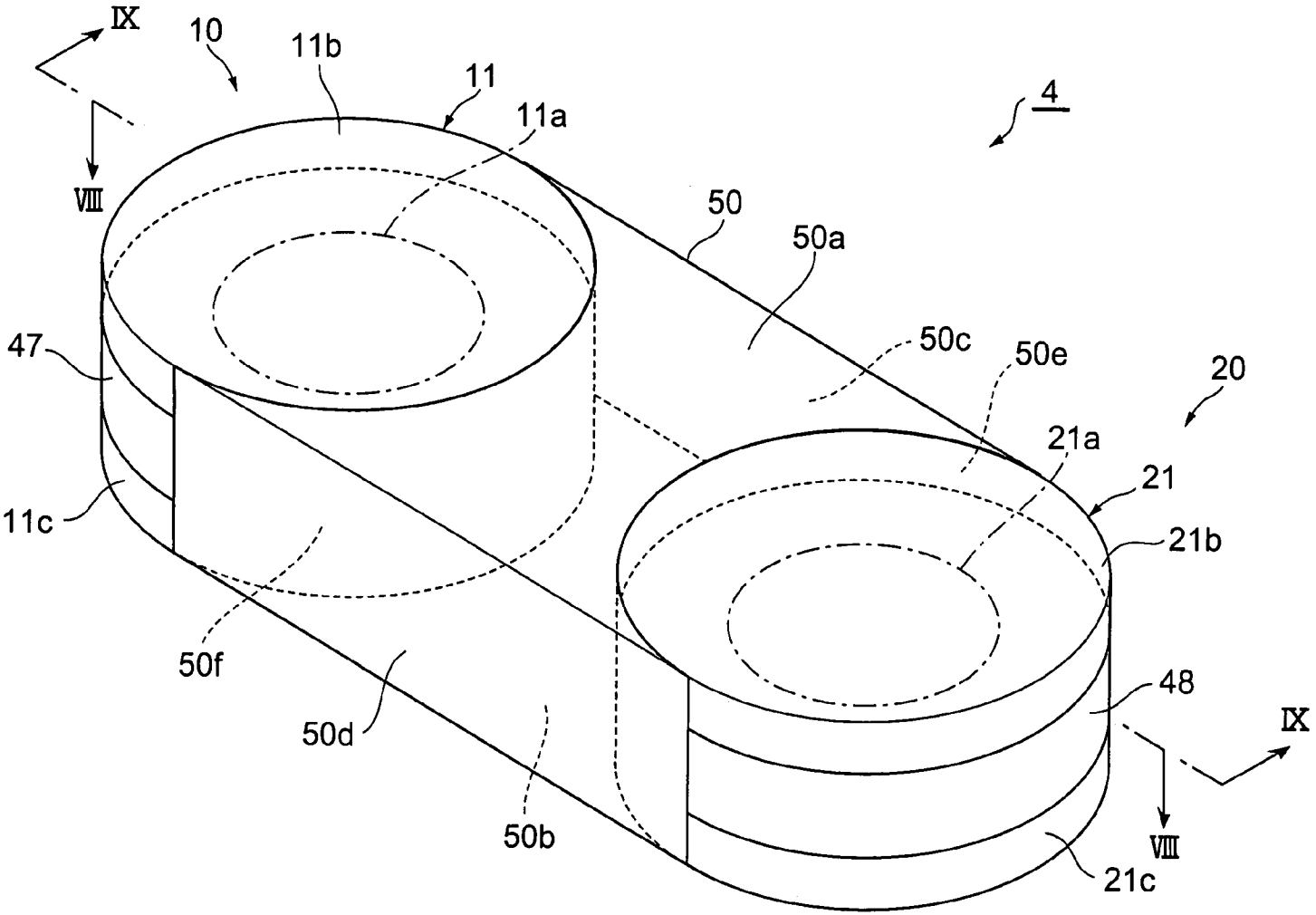
FIG. 7 is a perspective view of a coil component according to the second embodiment.
Figure 8:
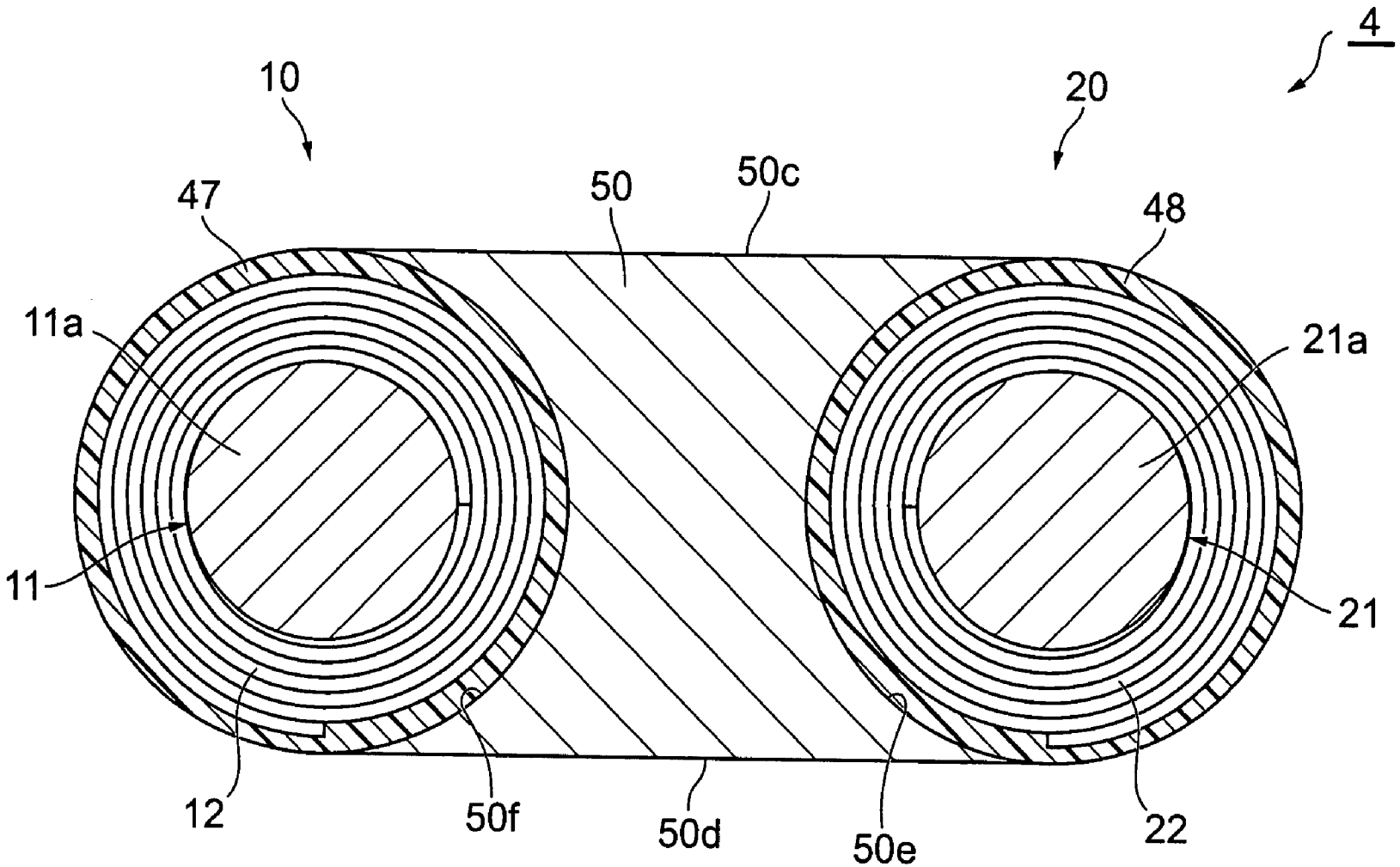
FIG. 8 is a schematic view showing an VIII-VIII cross section of the coil component shown in FIG. 7.
Figure 9:
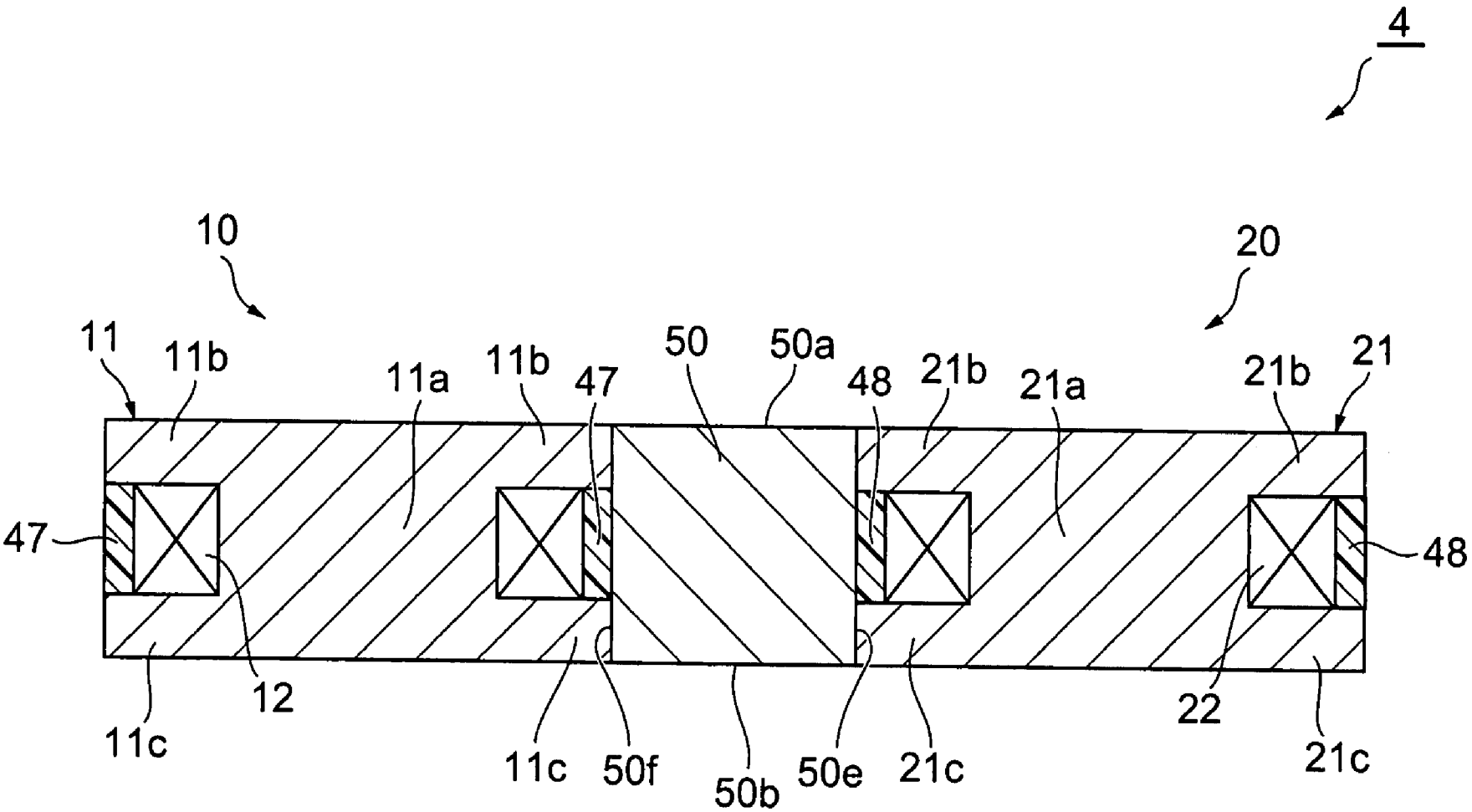
FIG. 9 is a schematic view showing a IX-IX cross section of the coil component shown in FIG. 7.

A configuration of a coil component 4 according to the second embodiment will be described below with reference to FIGS. 7 to 9. FIG. 7 is a perspective view of the coil component according to the first embodiment. FIG. 8 is a schematic view showing an VIII-VIII cross section of the coil component shown in FIG. 7. FIG. 9 is a schematic view showing a IX-IX cross section of the coil component shown in FIG. 7.

The coil component 4 of the present embodiment has a middle member 50 instead of the middle member 30 of the aforementioned coil component 1 and is made without the adhesive 35. The coil component 4 is composed of a first coil part 10 and a second coil part 20, and shield members 47, 48 formed in the respective first and second coil parts 10, 20, similar to those in the aforementioned coil component 3. FIG. 8 shows the cross section VIII-VIII normal to the axis I through the winding 12. FIG. 9 shows the cross section IX-IX in a plane including the axis I of the winding drum 11*a* and the axis I of the winding drum 21*a*.

The middle member 50 is located between the first coil part 10 and the second coil part 20 and couples the first coil part 10 and the second coil part 20 to each other. The middle member 50 includes a plane 50*a* and a plane 50*b* opposed in parallel to each other, a plane 50*c* and a plane 50*d* perpendicular to the planes 50*a*, 50*b* and opposed in parallel to each other, and a curved surface 50*e* and a curved surface 50*f* opposed to each other.

The planes 50*a* and 50*b* are planes perpendicular to the direction of the axes I of the winding drums 11*a*, 21*a*. The plane 50*a* is flush with the outside surface perpendicular to the axis I in the flange 11*b*. The plane 50*b* is flush with the outside surface perpendicular to the axis I in the flange 11*c*. Namely, the size in the direction parallel to the axes I in the middle member 50 is approximately equal to the size in the direction of the axes I of the first and second coil parts 10, 20.

The planes 50*c* and 50*d* are planes parallel to the direction of the axes I and the row direction of the first and second coil parts 10, 20. The distance between the plane 50*c* and the plane 50*d* is approximately equal to the diameter of the peripheral circles in the flanges 11*b*, 11*c*, 21*b*, 21*c*. The planes 50*c* and 50*d* are flush with two respective tangent planes to the peripheral circles of the flanges 11*b*, 11*c*, 21*b*, 21*c*, which are opposed to each other.

The curved surface 50*f* is located on the first coil part 10 side. The curved surface 50*f* is depressed on the curved surface 50*e* side and is closely bonded to the portion on the middle member 50 side of the first coil part 10. Namely, the curved surface 50*f* is closely bonded to portions on the middle member 50 side of the flanges 11*b*, 11*c* and the shield member 47. The curved surface 50*e* is located on the second coil part 20 side. The curved surface 50*e* is depressed on the curved surface 50*f* side and is closely bonded to the portion on the middle member 50 side of the second coil part 20. Namely, the curved surface 50*e* is closely bonded to the portions on the middle member 50 side of the flanges 21*b*, 21*c* and the shield member 48.

The middle member 50 is made of a material having the magnetic permeability lower than that of the core 11. The middle member 50 is made of a thermosetting resin or a thermoplastic resin, and the relative magnetic permeability $\mu$ thereof is approximately 1. When the middle member 50 is made of the thermosetting resin, the resin can be selected on an as-needed basis from epoxy resin, phenol resin, polyurethane, polyimide, and so on. When the middle member 50 is made of the thermoplastic resin, the resin can be selected on an as-need basis from polyethylene, polypropylene, polyvinyl chloride, acrylic resin, and so on.

The coil component 4 described above can be produced as described below. First, the first coil part 10 and the second coil part 20 are prepared. Then a resin containing a magnetic material powder is applied onto each of the first coil part 10 and the second coil part 20 to form the shield members 47, 48. Subsequently, the first coil part 10 and the second coil part 20 with the shield members 47, 48 thereon are placed at a predetermined distance in a forming frame for mainly forming the planes 50*a*, 50*b*, 50*c*, 50*d* of the middle member 50, and the resin as a material for the middle member 50 is poured into the forming frame.

When the material of the middle member 50 is the thermosetting resin, the resin is heated to cure, whereby the middle member 50 is molded integrally with the first coil part 10 and the second coil part 20 with the shield members 47, 48 thereon. When the material of the middle member 50 is the thermoplastic resin, the resin is poured into the forming frame and is left to harden, whereby the middle member 50 is molded integrally with the first coil part 10 and the second coil part 20 with the shield members 47, 48 thereon. It is also possible to adopt a method of first integrally molding the middle member 50 with the first coil part 10 and the second coil part 20 and thereafter forming the shield members 47, 48 thereon.

In the coil component 4 of the present embodiment described above, the middle member 50 having the magnetic permeability lower than those of the cores 11, 21 and the shield members 47, 48 is located between the first coil part 10 and the second coil part 20 and therefore the crosstalk between the first coil part 10 and the second coil part 20 is reduced thereby.

Since in the coil component 4 the shield members 47, 48 are formed so as to connect between the upper and lower flanges on the outside surfaces of the windings 12, 22 in the wound state in the respective first and second coil parts 10, 20, the separate magnetic paths are formed in the first and second coil parts 10, 20.

In the coil component 4 the cores 11, 21 have the flanges 11*b*, 11*c*, 21*b*, 21*c* located at the ends of the winding drums 11*a*, 21*a* and the shield members 47, 48 are formed between the flange 11*b* and the flange 11*c* and between the flange 21*b* and the flange 21*c*, respectively. This permits a closed magnetic path to be made by the winding drum 11*a*, 21*a*, the flanges 11*b*, 11*c*, 21*b*, 21*c*, and the shield member 47, 48 in each of the first and second coil parts 10, 20.

Since in the coil component 4 the shield members 47, 48 are resinous, they can be readily formed at any positions on the first and second coil parts 10, 20 even in the coil component 4 of a compact size.

In the coil component 4 the magnetic permeability of the shield members 47, 48 is lower than that of the cores 11, 21. This allows the shield members 47, 48 to exercise a function equivalent to a gap, in the magnetic paths made by the cores 11, 21 and the shield members 47, 48, so as to enable achievement of excellent DC bias characteristic. Namely, it becomes feasible to achieve the DC bias characteristic as excellent as that in the structure in which the cores 11, 21 are provided with a gap.

Since in the coil component 4 the middle member 50 is the resinous member integrally molded with the first and second coil parts 10, 20, the middle member 50 is filled and hardened between the first and second coil parts 10, 20 and in gaps, so as to enhance the coupling strength between the first coil part 10 and the second coil part 20.

The necessary condition for the aforementioned shield members is that they are formed at least in part of the peripheral surfaces of the respective first and second coil parts 10, 20, and a variety of modifications can be contemplated as to the forming positions of the shield members. The shield members may be located between the flange 11*b* and the flange 11*c* and between the flange 21*b* and the flange 21*c*, or may be formed on the peripheral portions of the flanges 11*b*, 11*c*, 21*b*, 21*c*. For example, the aforementioned shield members 41, 42 may be formed in the respective first and second coil parts 10, 20, and the shield members 43-46 may be formed in the respective first and second coil parts 10, 20.

It is noted that the present invention is by no means limited to the above embodiments but can be modified in various ways. For example, the above embodiments showed the configurations in which the first coil part 10 and the second coil part 20 were similar to each other, but they may be formed so as to have mutually different inductance characteristics of the first coil part and the second coil part. In that case, the numbers of turns of the windings in the first coil part and in the second coil part may be made different from each other, or the magnetic permeability of the cores or the shield members may be made different from each other, in order to achieve the different inductance characteristics of the first coil part and the second coil part. As long as the shield effect is exhibited, the first coil part and the second coil part may be made different in the position where the shield member is located, the area covering the winding, or the like.

The above embodiments showed the examples in which the contours of the flanges 11*b*, 11*c*, 21*b*, 21*c* of the first coil part 10 and the second coil part 20 were circular, but they may be formed in a polygon such as a quadrilateral or an octagon.

The middle member 50 was formed in the second embodiment, but it is also possible to adopt a method of, while forming the middle member 50, molding the material of the middle member 50 in a state in which terminal electrodes are electrically connected with the first coil part 10 and the second coil part 20 and exposed in part. This enables insert molding of the terminal electrodes simultaneous with the molding of the middle member 50.

The above embodiments used the cores 11, 21 with the relative magnetic permeability μ of about 300, but it is also possible to use those with the relative magnetic permeability of about 200 to 800.

What is claimed is:

1. A coil component comprising:

a first coil part and a second coil part each of which includes a core having a winding drum and a flange located at least at one end of the winding drum, and a winding arranged in the winding drum;

a middle member located between the first coil part and the second coil part arranged in a state in which axes of the winding drums in the respective first and second coil parts are parallel to each other;

a resinous first shield member formed at least in a part of a peripheral surface of the first coil part and containing a magnetic material powder; and a resinous second shield member formed at least in art of a peripheral surface of the second coil part and containing a magnetic material powder;

wherein a magnetic permeability of the middle member is lower than that of the core and the first and second shield member; and wherein the first and second shield members are separated from each other so as to form respective different closed magnetic paths for the first coil part and for the second coil part.

2. The coil component according to claim 1, wherein the middle member is bonded to the flange with an adhesive.

3. The coil component according to claim 1, wherein the middle member is a resinous member and is in close contact with the first and second coil parts.

4. The coil component according to claim 1, wherein a magnetic permeability of the shield member is lower than that of the core.

5. The coil component according to claim 2, wherein a magnetic permeability of the shield member is lower than that of the core.

6. The coil component according to claim 3, wherein a magnetic permeability of the shield member is lower than that of the core.

* * * * *